United States Patent [19]

Kawasaki et al.

[11] Patent Number: 4,517,651

[45] Date of Patent: May 14, 1985

[54] AUTOMATIC VENDING MACHINE

[75] Inventors: Kikuo Kawasaki; Tomomi Sano, both of Tokyo, Japan

[73] Assignee: Fuji Electric Company, Ltd., Kanagawa, Japan

[21] Appl. No.: 311,466

[22] Filed: Oct. 14, 1981

[51] Int. Cl.[3] ..... B67D 5/06

[52] U.S. Cl. ..... 364/479; 222/641; 222/129.4; 222/144.5; 222/639

[58] Field of Search ..... 364/465, 900, 479; 222/2, 30, 70, 26, 144.5, 36, 129, 129.1, 129.2, 129.3, 129.4, 640, 641, 642

[56] References Cited

U.S. PATENT DOCUMENTS

| | | | |
|---|---|---|---|
| 3,878,377 | 4/1975 | Brunone | 222/26 |
| 3,904,079 | 9/1975 | Kross | 222/2 |
| 3,991,911 | 11/1976 | Shannon et al. | 222/641 |
| 4,011,967 | 3/1977 | Halsey et al. | 222/641 |
| 4,162,028 | 7/1979 | Reichenberger | 222/129.4 |
| 4,234,102 | 11/1980 | Spurgeon | 364/479 |
| 4,276,999 | 7/1981 | Reichenberger | 222/129.4 |
| 4,328,539 | 5/1982 | Heeger | 222/641 |
| 4,353,482 | 10/1982 | Tomlinson et al. | 364/479 |

FOREIGN PATENT DOCUMENTS

| | | | |
|---|---|---|---|
| 2091449 | 7/1982 | United Kingdom | 364/479 |

*Primary Examiner*—Gareth D. Shaw
*Assistant Examiner*—Jameson Lee
*Attorney, Agent, or Firm*—Brumbaugh, Graves, Donohue & Raymond

[57] ABSTRACT

A beverage vending machine makes use of a microcomputer to compute the time duration for supply of component materials in accordance with stored data and supplied input data.

4 Claims, 3 Drawing Figures

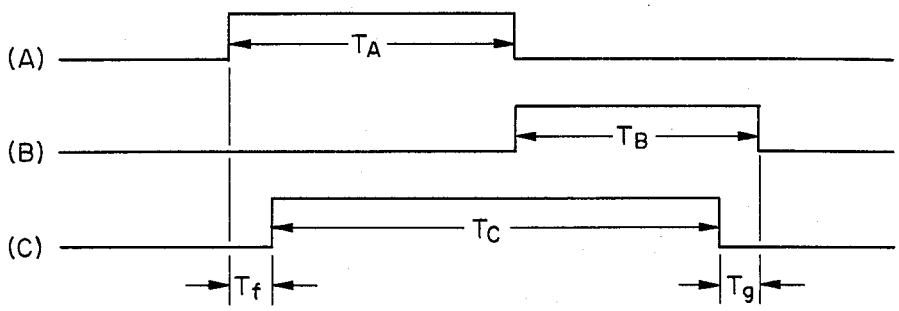

FIG. 1

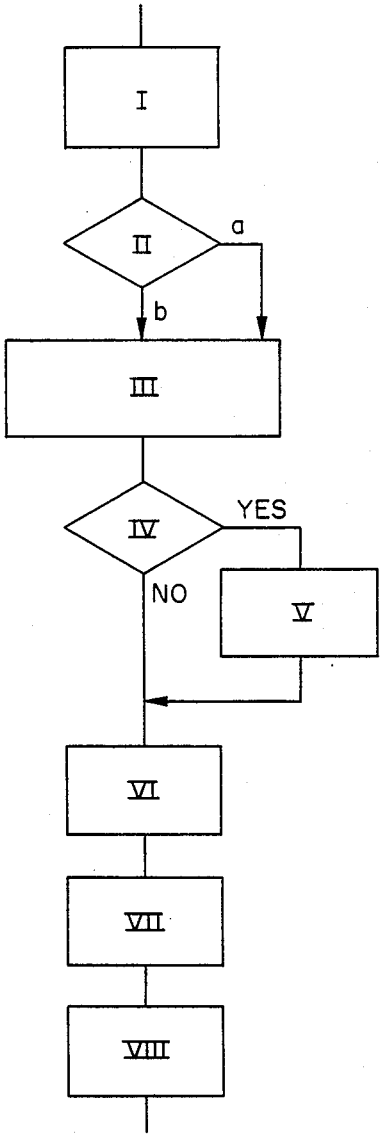

I: READ DESIGNATIVE DIGITAL INDEX DDI (DDI: 4 BIT SIGNAL)

II: RECEIVING CUP SIZE INFORMATION (1 BIT SIGNAL) a: LARGE, b: SMALL

III: READ OUT DURATION LT CORRESPONDING TO DDI AND CUP SIZE

IV: RECEIVING ICE REQUIREMENT INFORMATION (1 BIT SIGNAL)

V: REDUCE THE VALUE CORRESPONDING TO ICE MASS FROM LT

VI: READ CARBORATION RATE OPTION (3 BIT SIGNAL)

VII: CALCULATE $T_A$ AND $T_B$

VIII: CALCULATE $T_C$ ($T_C = T_A + T_B - T_f - T_g$)

FIG. 2

AUTOMATIC VENDING MACHINE

TECHNICAL FIELD OF THE INVENTION

This invention relates to a microcomputer controlled automatic vending machine for serving plural kinds of commodities prepared from plural kinds of materials, and more specifically to an economical system wherein a relatively small number of informational control inputs to the microcomputer is sufficient for preparing materials for a variety of commodities.

DESCRIPTION OF THE PRIOR ART

In vending carbonated beverages such as Coca Cola, for example, basic materials such as carbonated water, plain cold water and syrup are mixed under certain conditions and served. Customarily, the mixing conditions are dictated by predetermined values of the carbonation rate and the Brix index. The carbonation rate is a ratio between the quantity of carbonated water and plain cold water to be mixed. The Brix index is another ratio between the quantity of carbonated water plus plain cold water and the quantity of syrup to be mixed. If both of the ratios, and the size or quantity of the commodity are specified, then all of the component material quantities can be obtained. Customarily, in order to feed respective quantities of materials at the predetermined ratios, it is known to set the values of the ratio settings according to the duration of time that the materials will be fed. Further, in an actual automatic vending machine, the control mechanism must not only control the material feed ratio function, but must also control various other functions which detect, check and read deposited coins, which supply cups for beverages, and which serve ice if required. Preferably, a microcomputer of a vending machine should serve for all such functions.

In some vending machines according to the prior art, the control function is a sequencer with a disc assembly, wherein adjusting the positions of discs in the sequencer serves to adjust the relative time durations for feeding the materials. In a vending machine of large capability for serving a relatively large variety of commodities, however, a disc type sequencer cannot satisfy the need for great variety of control and adjusting performances economically. Therefore, instead of the disc type sequencer, an electronic control with the microcomputer is generally used for such a purpose.

In either the disc type sequencer or the microcomputer, the control performance takes place mainly by adjusting the relative time durations for the various operations, such as the material feeding operations. This type of control is used primarily because direct detection and control of material quantity feed is expensive due to the costly sensors which are required, and in the case of a microcomputer, also involves a complicated control program. In contrast, control by time duration is rather easy and simple. Therefore, devices for supplying materials such as syrup, carbonated water and cold water should be provided with mechanisms for keeping respective material feed quantities generally constant per unit time period, and for providing some mechanical means to adjust those feed quantities per unit period.

When using a microcomputer, adjustment of feed quantities may be done by using on-off settings of external contacts to supply control information, in response to which the microcomputer directly regulates the material feed durations. However, that type of control, even for a vending machine which serves only one commodity, such as a beverage vending machine, often requires having the material feed durations variable, in order to facilitate a change in serving quantity i.e. change the size of the cup of beverage, and a change in ice supply. In order to serve various kinds of beverages in various component ratios, the microcomputer must be supplied with a great many types of input signals, and it is necessary to change the settings of operating durations of various parts of control or computing equipment whenever the serving quantity for a cup or the component ratios are varied. However, such requirements for computing equipment and its operation results in increased costs of manufacture and maintenance, which of source is a significant disadvantage of this customary control technique.

SUMMARY OF THE INVENTION

The present invention is directed to the abovedescribed disadvantages by providing an automatic vending machine having a microcomputer for control functions, for serving plural kinds of commodities including beverages or the like prepared from plural kinds of materials. The invention accomplishes the above not by separately setting the respective material feed durations in order to set component ratios, but instead by supplying the microcomputer with other kinds of control inputs, such as the values of Brix index and carbonation rate that indicate the component ratios for the materials. This results in minimizing the number of microcomputer control inputs and simplifying the configuration of the input circuit supplying the control inputs, with a minimized manufacturing cost of the control system of the vending machine, while having adequate capability for changing the quantity of beverage served, and with minimized costs for maintenance of parts for setting of the control system or the like.

More specifically, the invention is directed to a microcomputer controlled automatic vending machine for serving plural kinds of commodities prepared from plural kinds of component materials. The machine comprises storage means for storing a list of numerical data and inputed control data and input means for inputing control data whose value is proportional to the desired quantity of a commodity to be vended and desired ratios between the component materials comprising the commodity to be vended. The microcomputer has calculating means for calculating a set of material feed values representative of the respective time duration intervals that the plural materials are dispensed, in accordance with predetermined criteria which include the inputed control data and stored numerical data. Control means are provided for actuating the feed of the plural respective materials in response to the respective material-feed values, so that a commodity is prepared from the feed component materials and then served.

Numerous other advantages and features of the present invention will become readily apparent from the following detailed description of the invention and of one embodiment thereof, from the claims and from the accompanying drawings.

BRIEF DESCRIPTION OF THE DRAWINGS

FIG. 1 is an operational chart showing the relative feeding of materials over time, according to the invention;

FIG. 2 is a flow chart illustrating steps of a duration calculating method according to the invention.

DETAILED DESCRIPTION OF THE PREFERRED EMBODIMENT

Figure 3:
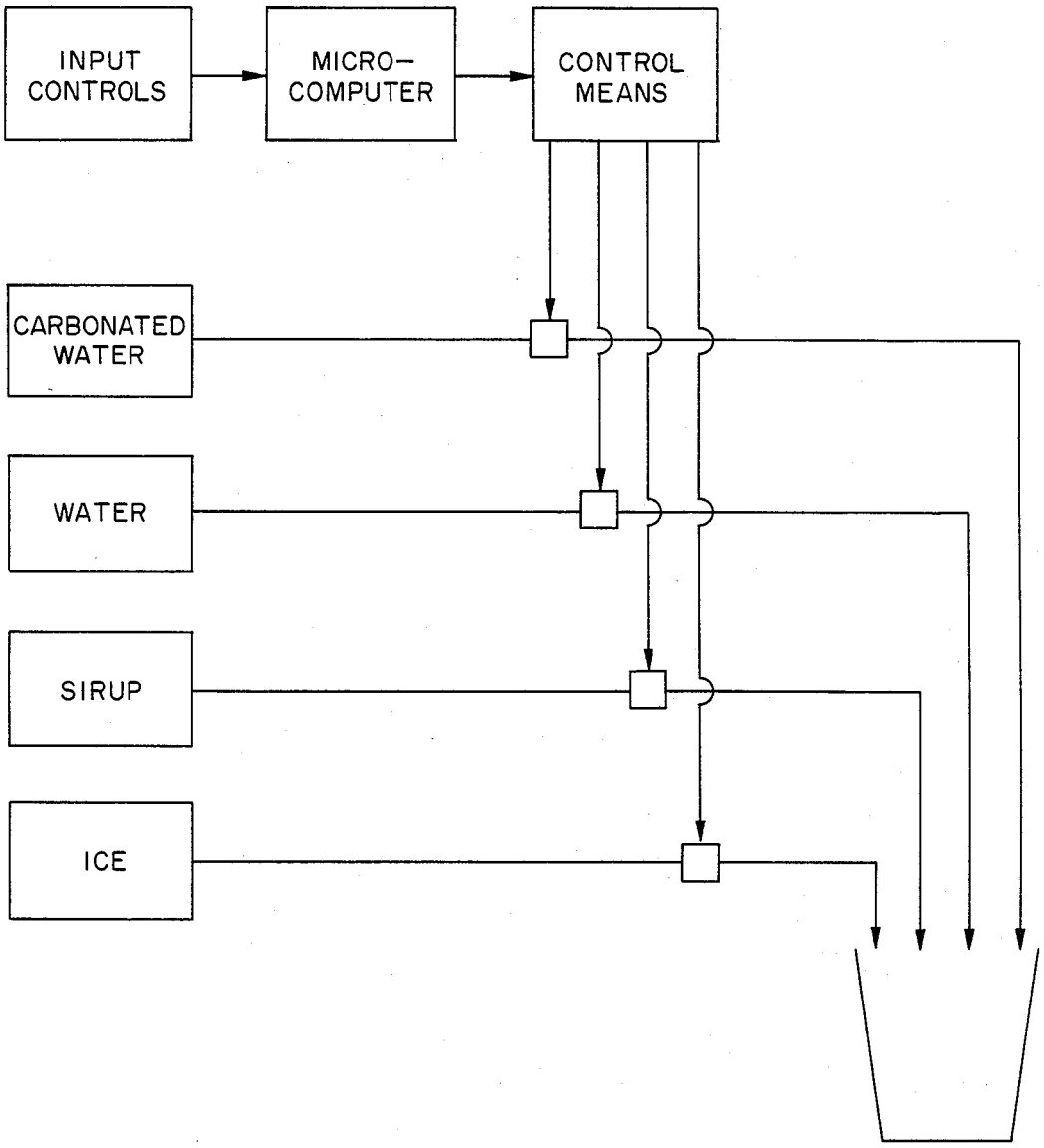
FIG. 3 is a block diagram of an electrical circuit according to the invention.

FIG. 1 is an example of an operation chart of feeding the materials according to the invention. The three lines from left to right are plotted against time. The first time duration $T_A$ is the duration of operation for feeding a vend unit of a first material, which in this case is carbonated water. A second time duration $T_B$ is the time duration for feeding a second material, which in this case is plain cold water. A third time duration $T_C$ is the time duration for feeding a third material, which in this case is soda syrup. The third time duration $T_C$ has a length approximately equal to the sum of lengths of the first and second durations $T_A$ and $T_B$, but they are arranged so that the third duration $T_C$ begins after the beginning of the earlier of time durations $T_A$ and $T_B$ by a certain time interval $T_F$. The third duration $T_C$ ends earlier than the end of the later of durations $T_A$ and $T_B$ by another certain interval $T_G$. Such an arrangement of time interval durations facilitates good mixing of syrup with carbonated and cold water, in view of the physical property of syrup.

The lengths of the time durations $T_A$, $T_B$ and $T_C$ are calculated in the microcomputer according to a calculating process using a predetermined criteria and control inputs. In the invention, the lengths of the durations $T_A$, $T_B$ and $T_C$ themselves are not control inputs, but instead are calculated in the microcomputer. Such an arrangement results in a fewer number of control inputs being needed.

FIG. 2 is a flow chart showing an embodiment of such a duration calculating process in the invention. As stated above, the Brix index is the ratio between the quantity $T_C$ and the quantity $T_A$ plus $T_B$. In this embodiment, a choice among various values of the Brix index may or may not be available as an option to customers buying the commodities. However, a choice of a particular carbonation rate, which gives the ratio between $T_A$ and $T_B$, should be an option available to customers. Other possible options are choice of kinds of commodities, choice between two kinds of cup size, and choice between the supply with or without ice.

The microcomputer is provided with a memory, in which a list of numerical data has been previously stored. The list indicates a variety of lengths of time LT corresponding to given combinations of designative digital indexes (DDIs) and cup sizes. The designative digital indexes serve to communicate information indicating the kinds of commodities. If they are represented by digital signals of four bits in binary code, the number of such digital indexes can be labeled by numbers from No. 0 through No. 15, for example. Values of the length of time LT are used to give time durations $T_A$ and $T_B$ as mentioned below. Such lengths of time are naturally within a certain appropriate range. In most cases, two digit precision (i.e.: of x.x sec.) is required for proper representation of such duration. The stored data in the memory are of course changeable when required. An example of the data to be stored may be as follows:

| Designative digital index (DDI) | Duration (LT) in seconds | |
|---|---|---|
| | large cup | small cup |
| 0 | 3.0 | 2.0 |
| 1 | 3.1 | 2.1 |
| 2 | 3.2 | 2.2 |
| 3 | 3.3 | 2.3 |
| 4 | 3.4 | 2.4 |
| 5 | 3.5 | 2.5 |
| 6 | 3.6 | 2.6 |
| 7 | 3.7 | 2.7 |
| — | — | — |
| — | — | — |
| — | — | — |
| 15 | 4.5 | 3.5 |

In the case illustrated, the number of available cup sizes is two, which can be represented by a one bit signal in binary code.

In the memory of the microcomputer, other data are also stored, which are used for changing the carbonation rate to a value chosen. Generally, a choice among about 8 kinds of changeable values of the carbonation rate is adequate for a usual vending machine. So, signals to communicate such option to the microcomputer can be of 3 bits in binary code, produced for example by three digital switches. The memory region needed for storing this amount of data is relatively small.

When a customer has chosen a particular commodity by manipulating a certain input mechanism of the vending machine, a signal is produced representative of one designative digital index DDI, which is supplied to the microcomputer (see block I in FIG. 2). The customer can also choose one of the two cup sizes by manipulating another certain input mechanism, which produces another signal also supplied to the microcomputer (see block II in FIG. 2). The microcomputer then reads out, from its memory, one of the time lengths LT determined by the particular digital index DDI and the particular cup size (see block III in FIG. 2). The read-out value of the time length LT represents the sum of the first and second duration $T_A$ and $T_B$ for serving the selected commodity.

Next, the customer chooses whether the commodity should be served with or without ice (see block IV in FIG. 2). In the case where ice supply is required, the total water quantity i.e. the sum of carbonated water and plain cold water quantities to be supplied, should be reduced by a mass corresponding to that quantity of the ice, and therefore the above read-out length of time LT is reduced by the proportion corresponding to that mass (see block V in FIG. 2). In this embodiment, this reduction is set as a predetermined length of time, i.e the ice quantity to be supplied for a cup is predetermined. If ice supply is not required, the read-out value of length of time LT remains unreduced.

The next step (block VI in FIG. 2) is reading out the option of values of the carbonation rate (i.e. the ratio between $T_A$ and $T_B$). One of such values is read out from the memory according to the signal communicating its option. Now, both the values of LT (i.e. $T_A+T_B$) and of carbonation rate (i.e. $T_A/T_B$) have been given. With two equations and two unknowns, the values of $T_A$ and $T_B$ can both be worked out (see block VII in FIG. 2). A value of the third duration $T_C$ of feeding the other material, i.e. syrup, can then be calculated by $T_C=T_A+T_B-T_F-T_G$. Here, $T_F$ and $T_G$ are predetermined time intervals to be put before and after the duration $T_C$ in order to have good mixing of syrup with carbonated water and plain water as mentioned above.

The calculations of the material-feed durations $T_A$, $T_B$ and $T_C$ are relatively easy, and are within the capability of a typical microcomputer.

Thus, in the embodiment, the control inputs to the microcomputer consist of digital signals having a total of 8 bits in binary code, except the signal to indicate the choice between supply with or without ice. The 8 bits are: 4 bits for communicating the designative digital index (DDI) to represent the kinds of commodities, 1 bit for indicating cup sizes, and 3 bits for the choice of carbonation ratio. This results in a very large reduction of the number of bits of control input signals which are required, as compared with conventional techniques, (an example of which will be discussed below). Since the manufacturing cost of control equipment using a microcomputer is substantially dependent on the extent of complexity of control input circuit to the microcomputer (and not on the cost of the microcomputer itself), the invention provides for producing economical vending equipment while still providing a customer with many ranges of options.

In the above embodiment, changing the value of the Brix index can be done by varying the opening of the valve for the syrup. If implemented in this manner, the Briz index adjustment is not controlled by the microcomputer. The value of the Brix index may vary slightly with a variation in the values of the sum of the durations $T_A$ and $T_B$, since the intervals $T_F$ and $T_G$ remain unvaried. Particularly, changing the condition of supply with or without ice can cause a rather appreciable change of the total time duration $T_A+T_B$, and therefore of the Brix index. Practically, however, the total time duration $T_A+T_B$ is much longer in comparison to the sum of the time intervals $T_F$ and $T_G$, so that the above variation in the Brix index does not substantially affect the quality of the beverage to be served. Therefore, the amount of variation is acceptable.

Also, if more than eight kinds of carbonation rates are required, by using a digital signal having four bits in binary code, which will increase the number of choices to sixteen, will suffice for most applications. This increase can be obtained at only a slight increase of the microcomputer memory inputs and its capacity.

For the purpose of comparing the number of bits required for control input signals, an example of conventional techniques will be read below.

Suppose that values of the material-feed durations $T_A$, $T_B$ and $T_C$ have to be obtained from some means outside of a microcomputer and then supplied to it as control inputs, and that the precision of two decimal places is also required for representing them. To convey information of two decimal places (such as x.x sec.), 8 bits in binary code are generally required. For information about the three material-feed durations $T_A$, $T_B$ and $T_C$, the required number of bits is threefold or 24 bits. Also, the options of cup sizes and of supply with or without ice should be communicated as control inputs to the microcomputer. Thus the required number of birts of signals is $3\times8$ for each of 4 situations, i.e for the combinations of situations of large or small cup size, with or without ice supply. That comes to a total of $3\times8\times4=96$ bits in binary code. Such a large number of signals in the microcomputer input circuit requires a relatively very large number of input signal setting elements, causing the equipment to be very expensive.

In contrast to the conventional process just described, the invention requires only 9 bits of input signals (inclusive of the signal for communicating whether to serve with or without ice), which is a substantial improvement.

A circuit for the machine is illustrated in the block diagram of FIG. 3, which shows an input control block, a microcomputer (which normally includes a memory, not separately shown), and a control means, which is typically an output buffer or the like. The control means regulates the respective durations of time that the supplies of carbonated water, plain cold water, syrup and ice are dispensed to a cup by means of conventional valves, as shown.

From the foregoing, it will be observed that numerous variations and modifications may be effected without departing from the true spirit and scope of the novel concept of the invention. It is to be understood that no limitation with respect to the specific apparatus illustrated herein is intended or should be inferred. It is, of course, intended to cover by the appended claims all such modifications as fall within the scope of the claims.

We claim:

1. A vending machine for vending plural kinds of commodities, with each commodity being formed from at least three component materials, comprising:

(1) input means for selectively inputing control data representative of a kind of commodity, a desired quantity of the commodity to be vended and desired ratios for said at least three component materials forms the commodity to be vended;

(2) a memory storing numerical data;

(3) a microcomputer, including a control program, for:

(a) selecting numerical data from said memory according to said input data, and (b) computing output feed time duration control signals, representative of corresponding feed times that each component material should be supplied at a respective constant feed rate to form a desired commodity, using said input data and said selected numerical data, and wherein the feed time duration control signal for the third component material is obtained by substracting signals representing first and second short time intervals from the sum of signals representing the feed time durations for the first and second component materials, said first and second short time intervals being relatively short compared to the time durations represented by the at least three time duration control signals;

(4) component supply means for supplying each of the three component materials at a substantially constant feed rate into a commodity container; and (5) control means, responsive to said output feed time duration control signals, for controlling the component supply means to cause said third component material to be dispensed during a period starting said first short time interval after the start of dispensing of said first component material and ending said second short time interval before the end of the dispensing of said second component material.

2. The machine as set forth in claim 1, wherein said third component material is syrup and said first and second component materials are carbonated water and plain cold water respectively.

3. The machine as set forth in claim 1 wherein said control means terminates dispensing the first component material approximately simultaneously with the beginning of dispensing the second component material.

4. The machine as set forth in claim 2 further including means for dispensing a fourth component material comprising ice in response to a control input, and wherein said microcomputer means reduces the signals representing the sum of the first and second time intervals to compensate for the presence of ice.

* * * * *